US006202840B1

(12) United States Patent
Chang

(10) Patent No.: US 6,202,840 B1
(45) Date of Patent: Mar. 20, 2001

(54) GOLF CLUB SECURING AND PROTECTION DEVICE FOR A GOLF BAG

(76) Inventor: Saeho Chang, 927 New Norwalk Rd., New Canaan, CT (US) 06840

( * ) Notice: Subject to any disclaimer, the term of this patent is extended or adjusted under 35 U.S.C. 154(b) by 0 days.

(21) Appl. No.: 09/173,544

(22) Filed: Oct. 16, 1998

(30) Foreign Application Priority Data

Jul. 25, 1998 (KR) ..... 98-30033

(51) Int. Cl.[7] ..... A63B 55/00

(52) U.S. Cl. ..... 206/315.4; 206/315.2; 150/159; 150/160

(58) Field of Search ..... 206/315.2, 315.3, 206/315.4; 150/159, 160; 211/70.2

(56) References Cited

U.S. PATENT DOCUMENTS 2,471,169 * 5/1949 Salzberg et al. ..... 206/315.4 X
2,879,819 * 3/1959 Turnball ..... 206/315.4 X
2,925,840 * 2/1960 Hird ..... 150/159
3,985,171 * 10/1976 Summer et al. ..... 206/315.4
4,383,563 * 5/1983 Kirchhoff, Jr. ..... 206/315.4 X
5,967,543 * 10/1999 Taylor ..... 206/315.4 X
5,988,378 * 11/1999 Bell, Jr. ..... 206/315.2

* cited by examiner

*Primary Examiner*—Stephen P. Garbe
*Assistant Examiner*—Tri M. Mai
(74) *Attorney, Agent, or Firm*—Jacobson, Price, Holman & Stern, PLLC

(57) ABSTRACT

An apparatus for use with a golf bag serves to secure and protect golf clubs contained in the golf bag. The apparatus includes at least one club head securing member for simultaneously securing one or more selected golf clubs contained in the golf bag. The club head securing member is provided with a middle portion for covering at least a portion of club heads of the selected golf clubs. Two extended portions are provided for allowing said middle portion to hold the selected golf clubs down onto the golf bag with a predetermined pressure, wherein one end of each extended portion integrally is extended from said middle portion. An attachment member is provided for detachably and length-adjustably attaching the other end of each extended portion to an upper portion of the golf bag to thereby maintain the predetermined pressure. The apparatus further includes a golf bag cover designed to fit over one or more club head securing member to provide additional protection.

5 Claims, 3 Drawing Sheets

GOLF CLUB SECURING AND PROTECTION DEVICE FOR A GOLF BAG

BACKGROUND OF THE INVENTION

1. Field of the Invention

The present invention relates to a golf bag; and, more particularly, a golf club securing and protection device, for use in the golf bag. More particularly, the present invention concerns a golf club protection device which is capable of partially or fully covering one or more golf club heads to thereby hold the heads down and secure them to the golf bag for the protection of the golf clubs during transportation of the golf bag.

2. Description of the Related Art

A typical golf bag sold in the marketplace today usually comes with various types of golf bag covers, each cover designed to be attached to the top section of the golf bag. These covers offer limited protection of golf clubs during transportation of the golf bag and containment of the golf clubs within the golf bag. Most of the golf bag covers are designed to fit comfortably over the golf bag containing golf clubs of different heights. Thus, the covers are not specifically designed to prevent the golf clubs from making vertical or other shaking movements inside the golf bag during transportation of the golf bag. These vertical and other shaking movements inside the golf bag cause the golf clubs to hit each other and often cause one club head to hit the shaft of another club, thus causing an unwanted damage to the clubs.

Furthermore, although some of the golf bag covers come with light padding, the padding is not sufficient to protect the clubs against forces that may be incurred from the outside of the golf bag cover. Therefore, a typical golf bag cover provided today does not provide effective club protection. In fact, many people buy a separate travel bag specially designed to put the entire golf bag therein, including the golf bag cover that comes with the bag, to provide an additional protection for the golf clubs.

Many people also use individual club head covers, especially for their driver and wood clubs, and put each head cover onto each club and then put their golf bag cover over the top of the entire golf bag during transportation. However, the part of each typical club head cover that is designed to protect the club shaft does not provide sufficient protection of the club shaft. For instance, the head of a shorter club may severely strike the club shaft of a longer club. On the other hand, in order to prevent any damage during transportation, some people wrap a soft towel around the neck of a longer golf club head, even after it is put into each individual head cover, before it is put into the golf bag cover and the entire bag is placed inside the padded travel bag designed to carry the golf bag.

Practically speaking, there is no device available in the marketplace that is designed to hold tightly one or multiple club heads onto the golf bag to minimize their movements inside the golf bag cover. Therefore, even with the use of a padded travel bag, the golf clubs are not effectively protected from the above disadvantage due to the club movements inside the golf bag cover. Consequently, most golfers use their golf bag cover as a rain cover, for storage, or as a simple cover for a cosmetic purpose.

Due to ineffectiveness of existing solutions, many people wind up wasting money to buy expensive club head covers and travel bags, trying to protect their clubs.

SUMMARY OF THE INVENTION

The present invention is directed to a golf club securing and protection device that substantially obviates the limitations and disadvantages of the related art.

A primary object of the present invention is to provide a golf club securing and protection device.

Another object of the present invention is to provide a golf club securing and protection device which minimizes club noise during transportation of the golf bag.

Another object of the present invention is to provide a securing and protection device which provides extra attention to the loss of clubs after a game as the devices are placed on the clubs, and also prevents the clubs from accidentally falling out of the bag during transportation.

Another object of the present invention is to provide a securing and protection device which eliminates the need for purchasing individual club head covers and a specially designed travel bag.

It is yet another object to convert an ordinary golf bag into a well-protected travel golf bag with minimum potential for club damage.

In accordance with an aspect of the present invention, an apparatus is provided for use with a golf bag, for securing and protecting golf clubs contained in the golf bag. The device generally, comprises at least one club head securing member which is made of a middle portion, two extended portions and an attachment member. The securing member simultaneously secures one or more selected golf clubs contained in the golf bag. The securing member includes a middle portion for covering at least a portion of club heads of the selected golf clubs. The two extended portions are connected to the middle portion and allow the middle portion to hold the selected golf clubs to the golf bag with a predetermined pressure. One end of each extended portion integrally extends from the middle portion. The attachment member detachably and length-adjustably attaches the other end of each extended portion to an upper portion of the golf bag to thereby maintain the predetermined pressure.

In particular, both extended ends of the strap-type material member are designed to be attached to and removed from the top of a golf bag. The middle section of the member is shaped in various forms and may contain a well padded pocket-like design which is to be placed over one or more club heads. The present invention further provides specially padded golf bag covers with a customized interior shape to fit tightly over the top of one or more said strap-like material members and over the top section of a golf bag.

Preferably the apparatus has long strap-like club securing members and a specially shaped and padded golf bag cover to be placed over such members. The securing members and cover cooperate to fully secure one or more golf clubs to the golf bag, keep the golf clubs inside the club compartments of the golf bag, and cover the club heads and any exposed club shafts with special padding during transportation of the golf bag. Hence, the club heads and shafts are fully protected from any potential damage that might otherwise occur during transportation of the bag.

BRIEF DESCRIPTION OF THE DRAWINGS

The above and other objects and features of the present invention will become apparent from the following description of preferred embodiments given in conjunction with the accompanying drawings, in which.

DETAILED DESCRIPTIONS OF THE PREFERRED EMBODIMENT

Figure 1:
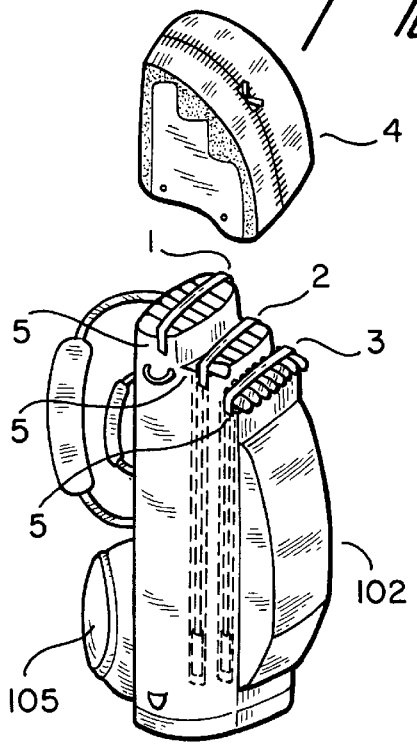
FIG. 1 is a perspective view of the golf bag with the strap-like club securing and protection devices, along with an accompanying golf bag cover, in accordance with one embodiment of the present invention.

In describing a preferred embodiment of the invention illustrated in the drawings, specific terminology will be used for the sake of clarity. However, the invention is not intended to be limited to the specific terms so selected, and it is to be understood that each specific term includes all technical equivalents which operate in a similar manner to accomplish a similar purpose.

The present invention primarily consists of two related components: (1) a strap system to hold the clubs onto the bag, and (2) a golf bag cover with extra heavy padding. The cover is custom-shaped to fit tightly over the strap devices in order to provide complete protection of the golf clubs against outside forces.

Referring to FIG. 1, there is shown a golf bag 102 employing a golf club securing and protection device in accordance with one embodiment of the present invention. The golf club securing and protection device includes a golf club sorting member 5, club head securing members 1,2 and 3 and a specially-designed golf bag cover 4.

In accordance with a first embodiment of the present invention, as shown in FIG. 1, each of the club head securing members 1, 2, 3 preferably comprise a strap-type member, which is designed to be placed over the sorted club heads. The strap forms a middle section of the securing member that extends over each deck of the bag. In accordance with another embodiment of the present invention, as shown in FIGS. 3A to 3F, the strap member has different forms to simultaneously cover and secure the sorted club heads.

Both ends of each of the club head securing members 1, 2, 3, are designed to be attached to connection points located at the sides of the golf bag. Accordingly, the sorted club heads under the middle portion of each of the club head securing members 1, 2, 3 is prevented from moving. Various means for attaching both ends of such members 1, 2, 3 may be provided, such as, for example, a pair of matching snap-on-and-off buttons or Velcro materials at the ends of each club head securing member and the side of the golf bag. During a golf game, these club head securing members are quickly and easily detached from the golf bag 102 for storage inside one of golf bag pockets 105. Alternatively, the securing member may be detached at one end, and left to hang freely from the bag at the other end.

The interior part of the golf bag cover 4 resembles the shape of the golf club sorting member 5, e.g., multiple decks, so that the cover can be placed tightly or integrally over the golf bag once the strap devices are secured onto the golf bag. Such multiple decks are further described in copending applications entitled "GOLF BAG FOR SECURING GOLF CLUBS" and "GOLF BAG HAVING MULTIPLE DECKS FOR ISOLATING CLUBS", each to Chang and filed concurrently herewith, each of which are incorporated herein by reference.

Figure 2:
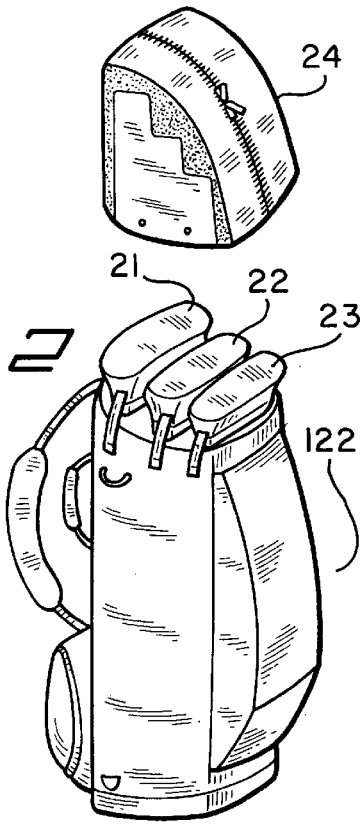
FIG. 2 is a perspective view of the golf bag with the strap-like club securing and protection devices, along with an accompanying golf bag cover, in accordance with another embodiment of the present invention.
Figure 3A:
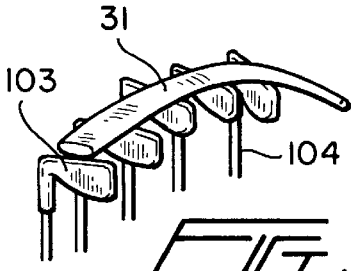
FIGS. 3A to 3F are perspective views of different types of potential strap-like club securing and protection devices and their cross-sectional views, which are appropriate for golf bags with club heads resting evenly along the edges of the club compartments, in accordance with the embodiment shown in FIG. 1.
Figure 3B:
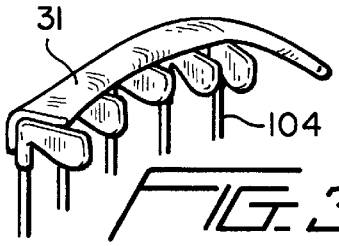
Figure 3C:
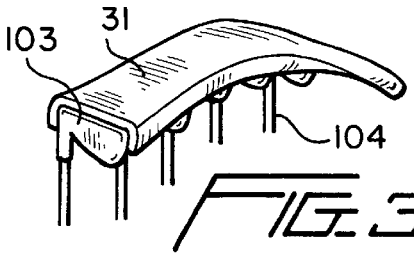
Figure 3D:
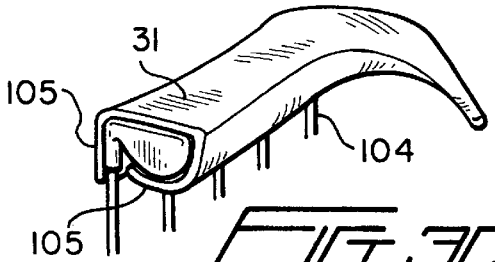
Figure 3E:
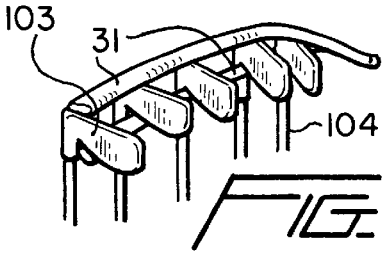
Figure 3F:
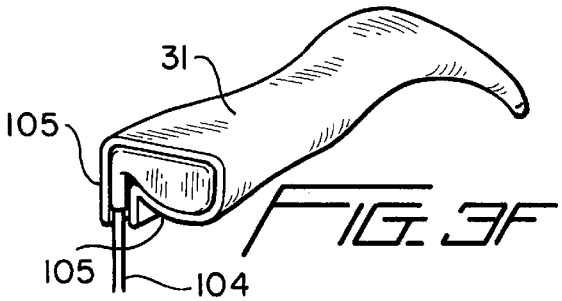

Referring to FIG. 2, there is shown a golf bag 122 employing a golf club securing and protection device in accordance with another embodiment of the present invention. As shown, the golf club securing and protection device includes club head securing members 21, 22, 23, and a golf bag cover 24. Unlike the golf club securing and protection device shown in FIG. 1, the golf club securing devices shown in FIG. 2 do not have a golf club sorting member 5 shaped as multiple decks. Therefore, the height of each of the club head securing members can change depending on the length of a group of the clubs that is exposed at the top of the golf bag and accommodated in one of the club head securing members 21, 22, 23.

For instance, the club head securing member 21, which is designed to cover the driver and wood clubs, will be much taller than the club head securing member 23, which is designed to cover short irons. The securing members preferably cover at least the club heads and the exposed part of the club shafts extending from the top of the golf bag 122. As with the first embodiment, the interior part of the golf bag cover 24 resembles the shape of the various heights of clubs at each deck so that the cover can be placed tightly over the golf bag 122 once the members 21, 22, 23 are secured to the bag 122.

FIGS. 3A, 3B, 3C, 3D, 3E, and 3F show various strap-type club head securing members 31. As shown, the strap-type club head securing members 31 cover one or more club heads 103, with each 10 head being covered either partially or fully. These club head securing members 31 can be made of materials, e.g., nylon, soft rubber, leather or fabric, and with or without soft padding. In the examples for the club head securing member 31 shown in FIGS. 3D and 3F, the sides and edges 105 of the club head securing member 31 that extend over the club heads 103 can be made of an elastic material so that it is easy to fully put the member 31 over the club heads 103 and so that the club heads 103 are tightly secured under such member 31.

Figure 4A:
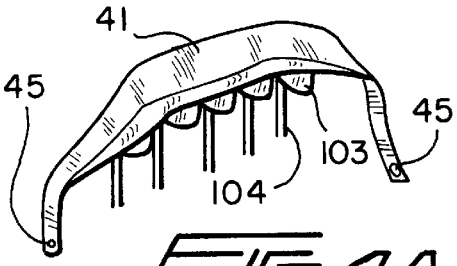
FIGS. 4A through 4D are perspective views of different methods of enabling adjustment of the length of the club securing and protection devices.
Figure 4B:
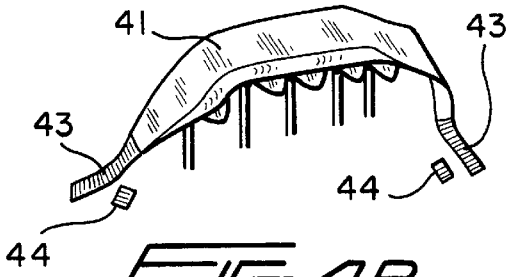
Figure 4C:
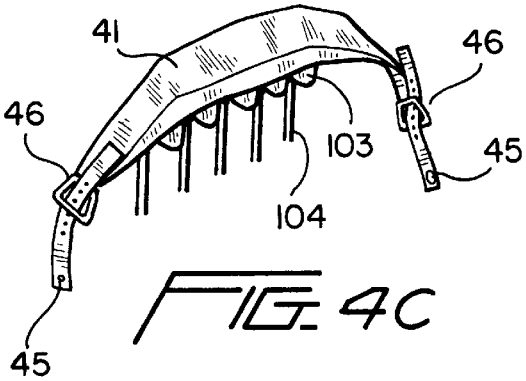
Figure 4D:
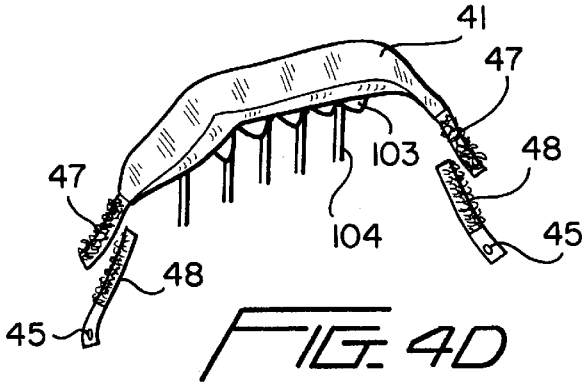

The ends of each club head securing member 31 shown in FIGS. 3A to 3F are attached to the side of the golf bag 102 or 122 as shown in FIGS. 1 and 2. To achieve this, the ends of the club head securing member 31 are provided with, e.g., snap-on-and-off buttons 45 or Velcro materials 43 and 44 as shown in FIGS. 4A through 4D. The Velcro material 44 is a matching piece to the Velcro material 43, and is to be glued or sewn onto the side of the golf bag 102 and 122. The Velcro materials 43 and 44 shown in FIG. 4B have the advantage of allowing the user to adjust the length of securing member due to stretching thereof over time or due to potentially different number of clubs to be secured onto the golf bag. On the other hand, if the snap-on-and-off buttons 45 is used in conjunction with a belt buckle-like mechanism 46 or the Velcro materials 47 and 48, as shown in FIGS. 4C and 4D, the length of each club head securing member can also be made shorter or longer depending on the desired length. In these cases, one or both ends of the securing members may be shortened or lengthened by adjusting the Velcro materials 47 and 48, a belt buckle-like mechanism 46, or the like near the end where button 45 is attached.

Referring to FIGS. 5A, 5B, 5C and 5D, pocket type club head securing members 51 are provided in accordance with another embodiment of the present invention. As shown, these members 51 are particularly appropriate for golf bags that allow the club heads to stick out of the bag unevenly across the club compartments. In this particular case, such as illustrated by FIG. 2, the club heads 103 are not evenly rested along the edges of the club compartments (as in FIG. 1). Therefore, the middle part of the club head securing member 51 are designed to contain a pocket-like feature so that the club heads 103 of different sizes and the exposed parts of their club shafts 104 can be covered fully before the said members are tied down to the side of the golf bag 102, 122.

Consequently, the height and the size of each of the pocket-type club head securing members 51 can change depending on the types of the clubs 103 to be covered and the shape of the top section of the golf bag 102 or 122. In FIG. 2, the height of each of the pocket-type club head securing member is made to be different from each other since the golf bag 122 is more like a traditional one with a flat top section. In contrast, if the top section of the golf bag 102 has multiple decks like in FIG. 1, the height of each of the club head securing members may be similar to each other.

Figure 6:
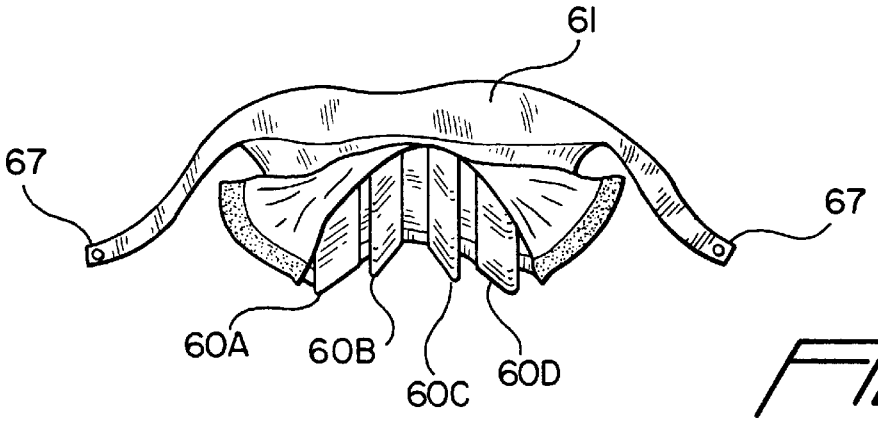
FIG. 6 is a perspective view of compartmentalization of the pockets-like part of the club securing and protection devices.

These pocket-like club head members 51 are padded with soft materials like sponge to protect the club heads 103 and shafts 104. In addition, each pocket-like club head member can include a number of compartments formed therein so that different clubs of different heights and head sizes can be accommodated individually as best shown in FIG. 6. Although only one club is to be preferably placed inside each compartment, the compartment may be designed to accommodate more than one club at a time.

The compartments are formed by attaching vertical dividers 60A to 60D onto the rear interior wall of the pocket-like club head securing member 61 as illustrated in FIG. 6. The top of the vertical dividers 60A–60D may optionally be attached to the top interior surface of the pocket type club head securing device 61. One advantage of not attaching the dividers 60A–60D to the top interior surface is to allow added flexibility so that the dividers may accommodate different heights of clubs 103. In addition, the clubs 103 fit more tightly inside the pocket-like part of each member 61. The dividers 60A to 60D can be also padded with soft materials like sponge so that clubs are protected from each other.

As shown in FIGS. 5A to 5D, the lower open part of the pocket-type middle portion of each club head securing member 51 can be provided with closure or tightening mechanisms 59A–59D for further securing the clubs contained therein. The tightening mechanisms 59 operate to tighten the sides of the securing member 51 about the club shafts. The mechanisms 59 are preferably located along the bottom edge of the securing device 51. The mechanisms fit the securing member to the clubs to further prevent movement of the clubs and to retain the securing device 51 to the clubs.

Figure 5A:
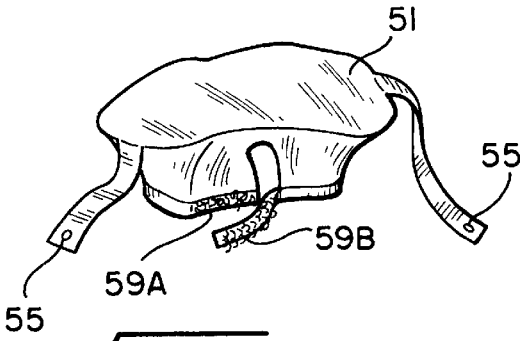
FIGS. 5A to 5E are perspective views of different types of potential pockets-like club securing and protection devices in accordance with the embodiment shown in FIG. 2.
Figure 5B:
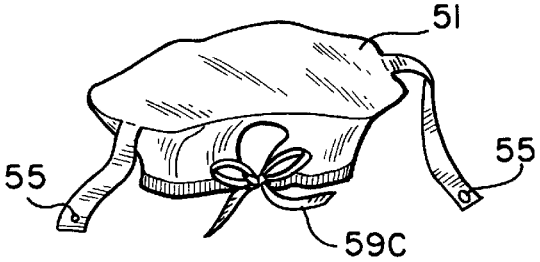
Figure 5C:
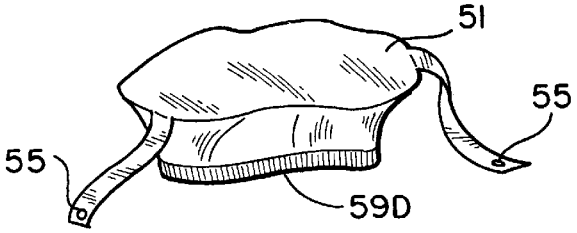
Figure 5D:
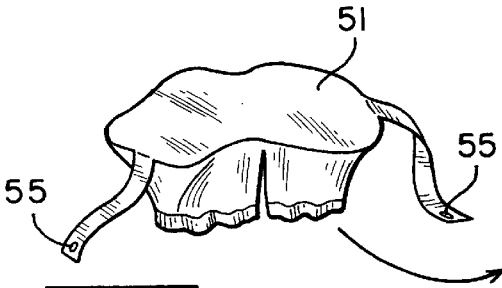
Figure 5E:
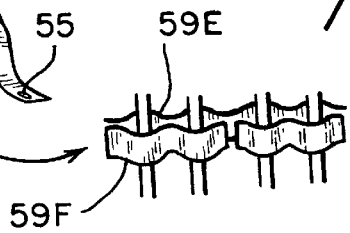

For instance, in FIG. 5A, the clubs placed in the club head securing member 51 are further secured by tightly connecting a Velcro strap 59B onto a matching Velcro strap 59A. In FIG. 5B, a string 59C extends around the bottom edge of the securing member. In FIG. 5C, an elastic band 59D is attached along the bottom edge thereof so that the securing member can be placed over the club heads 103 and shafts 104 to be covered. In FIG. 5D, a pair of matching Velcro straps 59E and 59F (shown in FIG. 5E) are attached to the interior wall of the pocket-like club securing member 51 along the bottom edge thereof so that one can quickly and further secure the clubs and their shafts on an individual basis. FIG. 5E also illustrates the club shafts 104 positioned between the Velcro materials 59E and 59F once the clubs are placed into individual compartments shown in FIG. 6. The design shown in FIG. 5E is a preferred way to secure each club separately so that they do not touch each other.

Both ends of the club head securing member 51 shown in FIGS. 5A and 5B, are provided with snap-on-and-off buttons 55 or Velcro materials 53 and 54 as discussed and illustrated with reference to FIGS. 4A and 4B. Even in this case, Velcro materials 53 and 54 can be more preferably used to further provide flexibility in length as required by different sizes of golf bags and different sizes of the clubs to be secured. Also, the snap-on-and-off buttons 55 can be used together with a belt buckle-like mechanism 46 or the Velcro materials 47 and 48 as illustrated in FIGS. 4C and 4D.

Figure 7A:
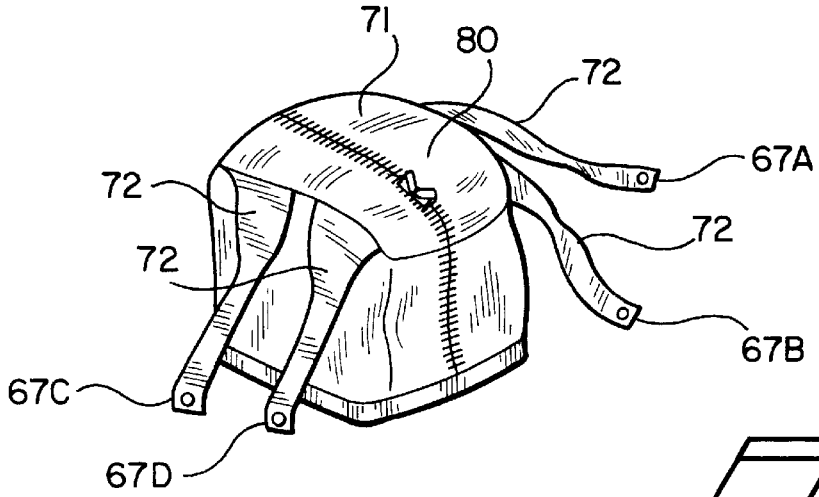
FIGS. 7A and 7B are perspective views of a club securing and protection device that is designed to cover a set of golf clubs across the entire golf bag, both outside and inside.
Figure 7B:
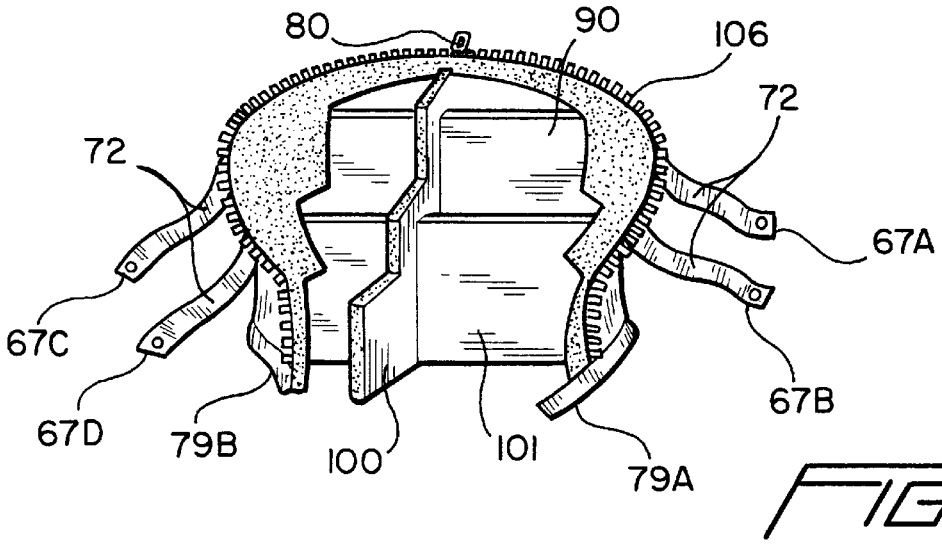

Referring now to FIGS. 7A and 7B, there is shown an integral-shaped club securing member 71 in accordance with another embodiment of the present invention. Here, the securing member is formed by integrally combining the club head securing members and the golf bag cover to thereby cover all the clubs in the entire bag 102, 122.

As shown, a single large pocket-like material member is provided to simultaneously retain all of the golf clubs across an entire golf bag 102, 122. FIG. 7A is a perspective view of a potential external shape of this particular embodiment of this invention and shows an example of how extended portions 72 can be attached to the said large pocket-type material member. The end of extended portions 72 are provided with snap-on-and-off buttons 67A–7D or Velcro materials 43 and 44 in FIG. 4B. In addition, the length of the extended portions can be made flexible by providing the belt buckle-like mechanism 46 or the Velcro materials 47 and 48 as shown in FIGS. 4C and 4D. FIG. 7B illustrates how the inside portion of such material member can be designed with padded sectional dividers 90, 100 and 101 which create club compartments by being attached to the interior walls of the material member or with each other. The custom padding 106 of the large pocket-type material member 71 is designed to fit tightly over the enclosed club heads and shafts, wherein the top interior surface of the said large pocket-type material member resembles an inverse shape of multiple decks which are formed naturally due to different heights of the golf clubs sticking out of a golf bag 122.

A zipper mechanism 80 is provided to allow opening of the material member 71 for easy and quick access. Around the lower open portion of the said large pocket-type material member 71 is a tightening mechanism 79A and 79B made of materials like Velcro strips to ensure that the lower open portion of the pocket-like material member is firmly tightened around the club shafts. In this case, an additional golf bag cover is not necessary, although it may provide extra club protection.

It is important to note that the club head securing members described above can be an integral part of the golf bag, or an incremental component which can be attached to the golf bag later as an independent product. In the case of providing the golf club securing and protection device incrementally, pieces of Velcro material with a sticky glue applied to the opposite side can be provided so that they can be glued onto the side of the existing bags to accommodate securing of the extended portions of the members.

While the present invention has been shown and described with reference to the particular embodiments, it will be apparent to those skilled in the art that many changes and modifications may be made without departing from the spirit and scope of the invention as defined in the appended claims.

I claim:

1. An apparatus, for use with a golf bag, for securing and protecting golf clubs contained in the golf bag, comprising:

A covering member for retaining all of the golf clubs across an entire golf bag, wherein a top interior surface of the covering member is an inverse shape of multiple decks; and at least one club head securing member for simultaneously securing one or more selected golf clubs contained in the golf bag, which includes:

a middle portion for covering at least a portion of club heads of the selected golf clubs;

two extended portions each connected at one end to said middle portion to secure the selected golf clubs to the golf bag; and a length adjustable attachment member located at the other end of said extended Portion for detachably attaching to an upper portion of the golf bag.

2. The apparatus as recited in claim 1, wherein said middle portion comprises a strap-type member.

3. The apparatus as recited in claim 1, wherein said middle portion covers the club heads of selected golf clubs.

4. The apparatus as recited in claim 1, further comprising a club sorting member for allowing the selected golf clubs of different heights to be accommodated by the club head securing member.

5. The apparatus as recited in claim 4, wherein said club sorting member includes one or more integrally formed deck-shaped compartments fixed on the upper portion of the golf bag, each deck-shaped compartment having a height based on an average height of a group of golf clubs accommodated therein.

* * * * *